US010147523B2

(12) United States Patent
Rengert

(10) Patent No.: US 10,147,523 B2
(45) Date of Patent: Dec. 4, 2018

(54) CABLE, METHOD OF MANUFACTURE, AND CABLE ASSEMBLY

(71) Applicant: Panasonic Avionics Corporation, Lake Forest, CA (US)

(72) Inventor: James Rengert, San Juan Capistrano, CA (US)

(73) Assignee: PANASONIC AVIONICS CORPORATION, Lake Forest, CA (US)

( * ) Notice: Subject to any disclaimer, the term of this patent is extended or adjusted under 35 U.S.C. 154(b) by 360 days.

(21) Appl. No.: 14/821,401

(22) Filed: Aug. 7, 2015

(65) Prior Publication Data

US 2016/0072238 A1 Mar. 10, 2016

Related U.S. Application Data

(60) Provisional application No. 62/047,871, filed on Sep. 9, 2014.

(51) Int. Cl.
*H01B 11/10* (2006.01)
*H01B 3/44* (2006.01)
(Continued)

(52) U.S. Cl.
CPC ..... *H01B 11/1091* (2013.01); *H01B 3/004* (2013.01); *H01B 3/445* (2013.01); *H01B 13/14* (2013.01)

(58) Field of Classification Search
CPC ..... H01R 13/6658; H01R 23/025; H01R 23/005; H01R 9/05; H05K 2201/10189; H01B 7/00; H01B 11/06; H01B 9/02
(Continued)

(56) References Cited

U.S. PATENT DOCUMENTS 1,721,218 A * 7/1929 Hood ..... H01B 7/00 174/115
2,446,387 A * 8/1948 Peterson ..... H01B 9/02 174/102 C
(Continued)

FOREIGN PATENT DOCUMENTS

CN 1841574 10/2006
CN 102388515 3/2012

OTHER PUBLICATIONS

State Intellectual Property Office of People's Republic of China, Notification of First Office Action, Application No. 201510570492.2 (Counterpart Application in China for present US application), dated Jul. 3, 2018, Beijing, China.

*Primary Examiner* — Abdullah A Riyami
(74) *Attorney, Agent, or Firm* — Vista IP Law Group LLP

(57) ABSTRACT

A cable for communicating electrical signals includes an outer sheath comprised of a polymeric material including an electrically conductive substance mixed with the polymeric material and causing the outer sheath to be electrically semiconductive. The outer sheath includes a plurality of insulated wires extending through the interior of the outer sheath along the length of the outer sheath. Each insulated wire includes an electrically conductive core surrounded by an electrically non-conductive material. A sheath ground wire disposed within the interior of the outer sheath extends along the length of the outer sheath. The sheath ground wire includes an electrically conductive core in direct electrical contact with the interior of the outer sheath at a plurality of locations

20 Claims, 7 Drawing Sheets

(51) Int. Cl.
*H01B 3/00* (2006.01)
*H01B 13/14* (2006.01)

(58) Field of Classification Search
USPC ..... 174/107, 113 B, 115, 116; 439/676, 528
See application file for complete search history.

(56) References Cited

U.S. PATENT DOCUMENTS 2,981,788 A * 4/1961 Bunish ..... H01B 9/028 174/103
3,023,267 A * 2/1962 Eager, Jr. ..... H01B 7/00 174/113 R
3,211,821 A * 10/1965 Wakefield ..... H01B 7/02 174/103
3,294,941 A * 12/1966 Mullen ..... G08B 17/06 174/110 R
3,297,814 A * 1/1967 McClean ..... G02B 6/4425 174/106 R
3,333,049 A * 7/1967 Humphrey ..... H01B 7/0036 174/102 SC
3,485,101 A * 12/1969 Cook ..... H01B 7/00 374/111
3,576,939 A * 5/1971 Ziemek ..... H01B 7/2825 156/54
3,681,515 A * 8/1972 Mildner ..... H01B 7/20 156/54
3,737,557 A * 6/1973 Verne ..... H01B 7/0208 174/107
3,816,644 A * 6/1974 Giffel ..... H01B 9/028 174/113 R
3,817,783 A * 6/1974 Verne et al. ..... H01B 3/004 156/51
4,228,475 A * 10/1980 Sherwood ..... H02H 11/001 324/510
4,268,714 A * 5/1981 Mori ..... H01B 11/1025 174/108
4,321,643 A * 3/1982 Vernier ..... G01R 31/024 324/509
4,374,299 A * 2/1983 Kincaid ..... H01B 11/1091 174/105 SC
4,454,379 A * 6/1984 Cleveland ..... H01B 7/2825 156/308.6
4,997,992 A * 3/1991 Low ..... H01B 11/12 174/113 C
5,186,656 A * 2/1993 Harwath ..... H01R 24/40 439/585
5,216,204 A 6/1993 Dudek et al.
5,218,167 A * 6/1993 Gasque, Jr. ..... H01B 11/1091 174/107
5,530,206 A 6/1996 Robert et al.
5,785,551 A * 7/1998 Libby ..... H01R 4/188 174/53
6,225,565 B1 5/2001 Prysner
6,259,019 B1 * 7/2001 Damilo ..... H01B 13/262 174/102 R
6,372,988 B1 4/2002 Burke et al.
6,486,395 B1 * 11/2002 Temblador ..... H01B 9/02 174/102 R
6,822,363 B2 * 11/2004 Leijon ..... H01F 3/10 174/DIG. 14
7,102,076 B2 * 9/2006 Goehlich ..... H01B 7/322 174/110 R
7,166,802 B2 * 1/2007 Cusson ..... H01B 7/20 174/105 R
7,399,198 B2 * 7/2008 Thalheimer ..... H04R 5/02 439/501
7,465,879 B2 * 12/2008 Glew ..... H01B 7/0892 174/113 C
7,654,860 B2 2/2010 Shih et al.
7,740,501 B2 * 6/2010 Ballard ..... H01B 9/003 174/105 R
7,880,089 B1 * 2/2011 Herrin ..... H01B 9/028 174/113 R
7,956,290 B2 * 6/2011 Wang ..... H01B 11/00 174/117 F
8,124,875 B2 * 2/2012 Aitken ..... H01B 9/028 174/102 R
8,222,525 B2 * 7/2012 Powers ..... H02G 1/083 174/110 R
8,247,695 B2 * 8/2012 Nakamura ..... H01B 7/30 174/113 R
8,303,337 B2 * 11/2012 Ballard ..... B60R 16/0207 174/113 R
8,358,894 B2 * 1/2013 Martin-Regalado ... G02B 6/443 385/100
8,435,069 B2 5/2013 Burke et al.
8,478,098 B2 7/2013 Hayashi et al.
8,492,648 B2 7/2013 Smith et al.
8,775,151 B2 * 7/2014 Algaonkar ..... G01K 11/32 385/13
8,842,954 B2 * 9/2014 Burris ..... G02B 6/4415 385/101
8,916,776 B2 * 12/2014 Cinquemani ..... H01B 9/025 174/120 R
8,937,253 B2 * 1/2015 Watanabe ..... A61M 25/09033 174/107
9,064,618 B2 * 6/2015 Kuchta ..... H01B 7/361
9,088,074 B2 * 7/2015 Heiks ..... G02B 6/4415
9,164,252 B2 * 10/2015 Worzyk ..... G02B 6/4416
9,193,586 B2 * 11/2015 Wei ..... B82Y 30/00
9,196,394 B2 * 11/2015 Jeker ..... H01B 1/24
9,269,477 B2 * 2/2016 Sato ..... H01B 11/1895
2010/0297873 A1 11/2010 Burke et al.

* cited by examiner

CABLE, METHOD OF MANUFACTURE, AND CABLE ASSEMBLY

CROSS-REFERENCE TO RELATED APPLICATIONS

The present application claims priority from prior co-pending U.S. provisional application Ser. No. 62/047,871, filed Sep. 9, 2014. Priority is hereby expressly claimed and the disclosure of the foregoing provisional application is incorporated herein by reference in its entirety and for all purposes.

TECHNICAL FIELD

The present invention relates generally to cables for vehicular entertainment systems and in particular to cables for use on entertainment systems for aircraft.

BACKGROUND

Cables for communicating electrical signals in entertainment systems for vehicles normally must meet requirements pertaining to electromagnetic interference (EMI). The requirements for EMI suppression are generally the most stringent for cables used on aircraft. There are two areas of the electromagnetic spectrum in aircraft that tend to be problematic. The first is the very high frequency range (VHF), reserved for pilot communication. The second is the frequency range reserved for the global positioning system (GPS). However, it is important to prevent EMI in other areas as well due to the potential for great loss of human life in aviation related accidents.

Cable manufacturers in the past have provided EMI suppression by including a sheath of internal copper braid or other metal or alloy disposed under an outer sheath of a polymeric material. While the braid suppresses EMI, it has disadvantages. One disadvantage is increased weight, an important factor in the aviation field, especially for commercial air transport where profit margins are typically low. In this regard, entertainment system cabling for commercial passenger aircraft can add significant weight to the vehicle.

Another disadvantage is that the braid increases the diameter of the cable and decreases flexibility. The increase size and decreased flexibility makes it more difficult to route the cable. Decreased flexibility is especially problematic because the cable is frequently used to connect to components of an entertainment system that require flexibility, such as a personal control unit, handset or game controller that passengers need to manipulate. Decreased flexibility makes it more difficult for passengers to manipulate the component and/or position it at a comfortable location.

In addition, the metal comprising the braid is subject to bending, which results in fatigue and eventually breaks. The breakage results in small, sharp pieces of metal becoming embedded in the cable outer sheath, which has resulted in injuries to persons handling the cable, such as aircraft passengers.

In the past, pieces of metal have also penetrated inward into the cable and caused shorts between wires in the cable. In particular, the metal pieces penetrate into the insulation surrounding wires in the cable and short one wire to another. The problem has become more acute with the introduction of USB connections through the cables. With USB, the cables carry more power and therefore short circuiting is more serious. There have been incidents causing smoke and/or fire. Smoke and fire is an incident reportable to the Federal Aviation Authority (FAA) and can force an aircraft to turnaround or land at the nearest airport, causing delay, inconvenience and increased costs to the airline and/or passengers.

Disclosed herein is a cable, a cable assembly, and method or process for making a cable and cable assembly that addresses the foregoing problems.

SUMMARY

In one embodiment, a cable is provided for communicating electrical signals. The cable includes an outer sheath comprised of a polymeric material including an electrically conductive substance mixed with the polymeric material and causing the outer sheath to be electrically semiconductive. That is, having an electrical conductivity between a metal and an electrical insulator. The outer sheath includes a plurality of insulated wires extending through the interior of the outer sheath along the length thereof. Each insulated wire includes an electrically conductive core surrounded by an electrically non-conductive material.

The cable further includes a sheath ground wire disposed within the interior of the outer sheath and extending along the length of the outer sheath. The sheath ground wire includes an electrically conductive core in direct electrical contact with the interior of the outer sheath at a plurality of locations. In one preferred embodiment, the sheath ground wire comprises a bare wire devoid of individual electrical insulation, in which the sheath ground wire includes an exposed core, formed of an electrically conductive material, such as a metal, metal alloy or combination thereof.

The cable preferably further comprises a plurality of electrically conductive strands forming at least one of the wires, and more preferably, all of the wires, including the sheath ground wire. In this regard, wires formed from many strands generally provider greater flexibility and are less apt to suffer an open circuit fault due to breakage as in single conductor wire. The plurality of insulated wires preferably includes at least one pair of the plurality that twist around one another along the length of the outer sheath for forming a twisted pair.

In a preferred embodiment, the electrically conductive substance mixed with the polymeric material comprises carbon. However, the electrically conductive substance may comprise other electrically conductive substances, such as particles of a metal or metal alloy, and combinations thereof with other metals or alloys and carbon.

The outer sheath includes a cross-section substantially corresponding to one of a rectangular shape and a circular shape. This includes rectangular shapes having rounded corners. Other shapes may be used as well, depending on the application. Notwithstanding, it is believed that circular and rectangular cross-sections will be satisfactory for the majority of applications.

In yet another preferred embodiment, the cable further comprises a binder or separation layer surrounding the plurality of insulated wires and separating the insulated wires from contact with the sheath ground wire in the interior of the outer sheath. The separation layer preferably comprises polytetrafluoroethylene. In one embodiment, the separation layer may comprise a tape wrapped around the insulated wires.

In another embodiment, a cable assembly is provided for communicating electrical signals. The cable assembly includes a cable including an outer sheath comprised of a polymeric material including an electrically conductive substance mixed with the polymeric material and causing the outer sheath to be electrically semiconductive. The outer sheath includes a plurality of insulated wires extending through the interior of the outer sheath along the length thereof. Each insulated wire includes an electrically conductive core surrounded by an electrically insulative material. The cable also includes a sheath ground wire disposed within the interior of the outer sheath and extending along the length thereof. The sheath ground wire includes an electrically conductive core in direct electrical contact with the interior of the outer sheath at a plurality of locations. The cable assembly further includes a cable retraction mechanism on which at least a portion of the cable is disposed. The cable retraction mechanism is operable to retract a greater portion of the cable thereto and also operable to extend more of the cable therefrom.

The outer sheath preferably includes a cross-section substantially corresponding to one of a rectangular shape and a circular shape. The cross-sectional shape may correspond substantially to a rectangular shape having one or more rounded corners and other geometrical shapes, depending on the application.

The cable assembly further includes a line-replaceable unit connected to the distal end of the cable. In one embodiment, the line control unit includes a USB port to which at least some of the insulated wires in the plurality of insulated wires in the cable electrically connect to the USB port. The sheath ground wire in the cable preferably connects to a ground in the line-replaceable unit. The other opposite end of the cable preferably has the sheath ground wire connecting to a ground in the cable retraction mechanism or to ground of a structure to which the cable retraction mechanism is mounted or fastened. Within the cable, the sheath ground wire is preferably a bare wire devoid of electrical insulation within the outer sheath.

In a preferred embodiment, the cable includes a separation layer surrounding the plurality of insulated wires and separating the insulated wires from contact with the interior of the outer sheath. The separation layer binds the plurality of insulated wires together and preferably comprises polytetrafluoroethylene. The separation layer separates the insulated wires from contact with the interior of the outer sheath and also from the sheath ground wire.

In still another embodiment, a method is disclosed for making a cable for communicating electrical signals. The method includes providing a plurality of electrically insulated wires, with each wire including an electrically conductive core surrounded by substantially electrically nonconductive material. The method additionally includes providing a ground wire. The ground wire is devoid of electrical insulation and includes an exposed electrically conductive core. The method further includes extruding an outer sheath around the electrically insulated wires and the ground wire, in which the outer sheath comprises a polymeric material mixed with an electrically conductive material. The electrically conductive material renders the outer sheath semiconductive, i.e., having a resistance between a metal and an electrical insulator.

Preferably, at least some of the electrically insulated wires are wrapped together prior to extruding the outer sheath. In a preferred embodiment, the wrapping comprises polytetrafluoroethylene. In addition, at least two of the insulated wires are preferably twisted or wrapped around one another along their length prior to extruding the outer sheath, to form a twisted pair of wires.

The extruding produces an outer sheath having one of a substantially rectangular cross-sectional area and a circular cross-sectional area. The cross-sectional area may include a shape corresponding substantially to a rectangle with rounded corners. In other embodiments, the cross-sectional area may correspond to other geometrical shapes.

Other aspects, details, and advantages will become apparent from the following description, taken in conjunction with the accompanying drawings, illustrating by way of example preferred and alternate embodiments.

BRIEF DESCRIPTION OF THE DRAWINGS

The drawing figures are not necessarily to scale and do not represent every feature, but are diagrammatic to enable those of ordinary skill in the art to make and use the invention without undue experimentation and do not limit the scope of the claims. Embodiments in accordance with the invention and advantages will therefore be understood by those of ordinary skill in the art by reference to the detailed description below together with the following drawings figures, wherein:

DETAILED DESCRIPTION OF PREFERRED EMBODIMENTS

Figure 1:
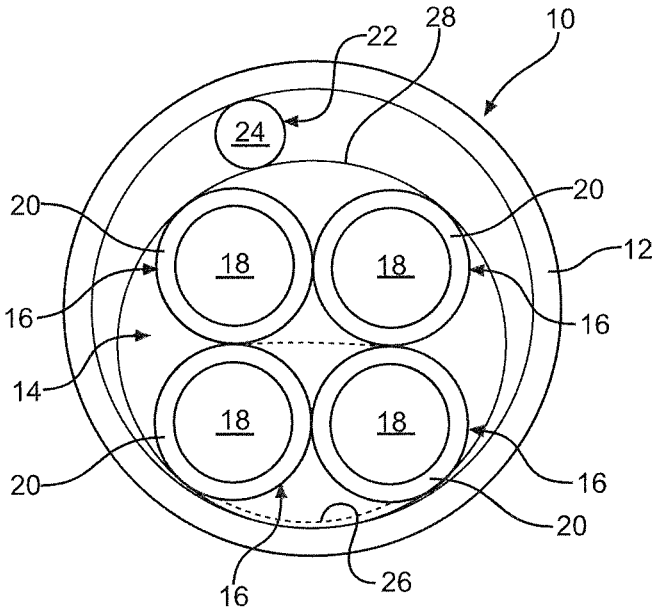
FIG. 1 illustrates a schematic cross-sectional diagram of an embodiment of a cable for communicating electrical signals.

Described in the following paragraphs are example embodiments. Turning to FIG. 1, the drawing figure schematically illustrates a cross-sectional diagram of an embodiment of a cable indicated generally by reference number 10 for communicating electrical signals. The cable 10 includes an outer sheath 12 comprised of a polymeric material. The polymeric material is preferably a thermoplastic elastomer, sometimes called a thermoplastic rubber, for providing both thermoplastic and elastomeric properties. More preferably, the polymeric material is a thermoplastic polyolefin elastomer. Thermoplastic polyolefin elastomers typically provide a broad hardness range and excellent properties with respect to fatigue and impact resistance, and resistance to acids, bases, and aqueous media. In addition, thermoplastic polyolefin elastomers offer robust processability and generally an excellent balance between performance and price. Other materials may be used as well for the outer jacket or sheath 12, such as polyvinyl chloride, polyethylene, polyamide, and materials with similar properties.

Satisfactory thermoplastic polyolefin elastomers for the outer sheath 12 are commercially available from the RTP Co. of Winona, Minn. In particular, the RTP Co. markets a thermoplastic polyolefin elastomer under the trademark 2899 X 134929 A, suitable for use in the embodiment illustrated in FIG. 1 and embodiments illustrated in other drawing figures herein. As will be appreciated by those skilled in the art, many other thermoplastic polyolefin elastomers could be used as well.

For suppression of electromagnetic interference ("EMI") from the cable, the outer sheath 12 includes an electrically conductive substance mixed with the polymeric material. In the foregoing thermoplastic polyolefin elastomer 2899 X 134929 A from RTP, the substance is carbon black, a form of paracrystalline carbon. Carbon black is typically produced by the incomplete combustion of heavy petroleum products, such as FCC tar, coal tar, and ethylene cracking tar. The electrically conductive substance could be other than carbon black, for example, metal particles, such as aluminum, copper, ferrite, steel, and other metals or alloys, combinations thereof and also with carbon black and/or other forms of carbon.

The electrically conductive substance mixed with the polymeric material results in an outer sheath 12 having electrical conductivity between that of a metal such as copper and an electrically insulative material, such as glass. It is often referred to as semiconductive within the plastics industry, but should not be confused with the term semiconductor as used in electronics for materials from which transistors are formed. While the sheath 12 has high resistivity compared to a metal, a six feet length (1.83 meters) of the sheath 12 has a resistance of between 100 kohms to 250 kohms, the surface resistance of the sheath material has a surface resistivity of less than 10 kohms. In addition, the volume resistivity is less than 100 ohm.cm and surface resistivity is less than 100 kohms/square.

A plurality of insulated wires extend through the interior of the outer sheath 12 as indicated generally by reference numeral 14. Each insulated wire 16 includes an electrically conductive core 18 surrounded by an electrically non-conductive material 20 for electrical insulation. The electrically conductive core 18 is comprised of a conventional metal or metal alloy, such as tinned copper, but may be comprised of other materials. For greater flexibility, the electrically conductive core 18 of each insulated wire 16 preferably comprises a plurality of electrically conductive strands. The electrically non-conductive material 20 that serves as insulation for the insulated wires 16 is a flexible coating of an electrical insulator, such as fluorinated ethylene propylene, often abbreviated as FEP. Other materials may be used as well such as high molecular weight polyethylene (HMPE), polyvinyl chloride (PVC), ethylene tetrafluoroethylene (ETFE), and etc.

In addition, a sheath ground wire 22 is disposed within the interior of the outer sheath 12. The sheath ground wire 22 extends along the length of the outer sheath 12 and includes an electrically conductive core 24 in direct electrical contact with the interior of the outer sheath 12 at a plurality of locations. The sheath ground wire 22 is a bare wire devoid of insulation and is more preferably in direct electrical contact with the interior of the outer sheath 12 for substantially the entire length thereof. The electrically conductive core 24 may comprise the same material as the cores 18 of each of the insulated wires 16. The electrically conductive core 24 of the sheath ground wire 22 is preferably smaller in diameter than the cores 18 of the insulated wires 16. In alternate embodiments, the core 24 of the sheath ground wire 22 may have a diameter as great as or greater than the cores 18 of the insulated wires 16. The insulated wires 16 preferably have diameters that are all substantially the same, but which may differ in alternate embodiments.

The plurality 14 of insulated wires 16 includes at least one pair 26 of the plurality twisted around one another along the length of the outer sheath 12. The oval in dashed line extending around the two insulated wires 26 indicates the pair of wires that are twisted around one another. Each wire 16 of the twisted pair 26 is for carrying an electrical signal that significantly cancels out the external field generated from an electrical signal transmitted by the other wire 16 of the pair to reduce EMI. If the cable 10 is for a USB connection, the twisted pair 26 is preferably used to transmit the electrical signals for the data lines of the USB connection.

The cable 10 further includes a binder or separation layer 28 surrounding the plurality of insulated wires 16. The separation layer 28 separates the sheath ground wire 22 from contact with the plurality 14 of insulated wires 16 and binds the insulated wires together. The separation layer 28 preferably comprises polytetrafluoroethylene, hereinafter abbreviated as PTFE. The most widely known brand of PFTE-based formulas is sold under the trademark TEFLON. The separation layer 28 is preferably applied in the form of a tape and entirely surrounds the plurality 14 of insulated wires 16. In particular, the tape is wrapped around the plurality 14 of insulated wires 16 to form the separation layer 29 preferably with an overlap of at least 25% in each revolution of the tape around the wires 16. The separation layer 28 reduces friction between the insulated wires 16 and the outer sheath 12 such that the insulated wires may slide within the outer sheath to reduce tension and prevent damage to the cable 10. The sheath ground wire 22 is not wrapped with the insulated wires 16 to maintain the sheath ground wire in direct electrical contact with the outer sheath 12 for better grounding.

Wrapping the insulated wires 16 together also helps to keep the insulated wires together when forming the cable 10 as an extrusion, explained in more detail later. As illustrated in FIG. 1, the cross-section of the cable 10 substantially corresponds to a circular shape. A circular cross-section has advantages in that it facilitates winding onto a spool or reel. In alternate embodiments, the cross-section may substantially correspond to a rectangular shape or other shapes. A rectangular shape has advantages in that it may decrease the bend radius.

Figure 2:
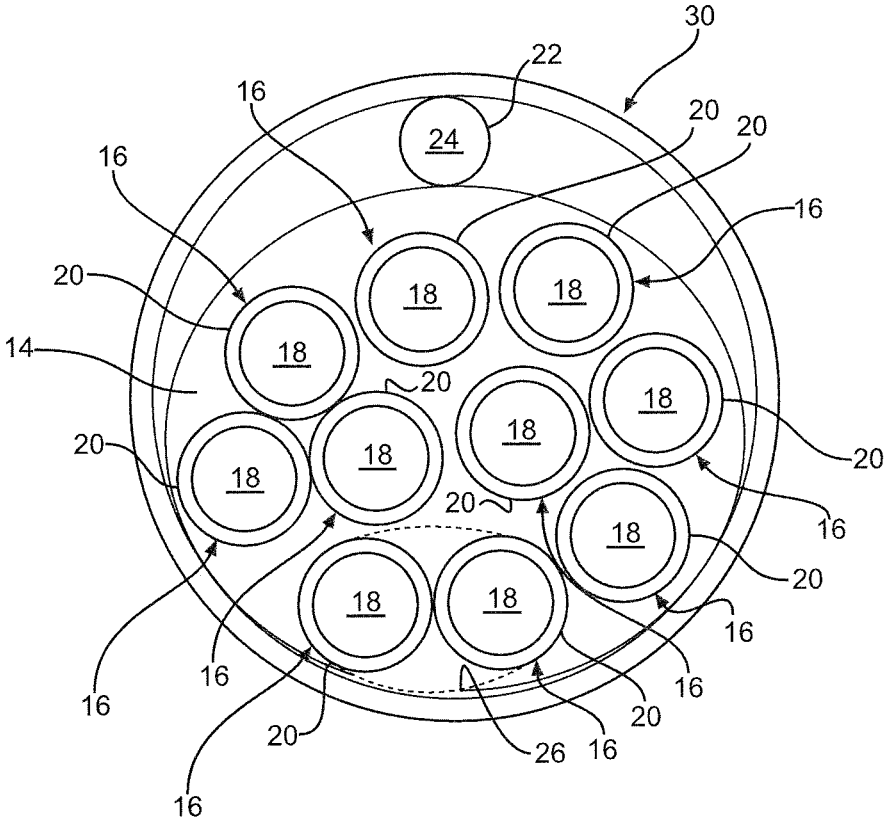
FIG. 2 schematically illustrates a cross-sectional diagram of another embodiment of a cable accommodating additional wires relative to the embodiment of FIG. 1.

FIG. 2 schematically illustrates a cross-sectional diagram of another embodiment of a cable 30 in which like reference numerals are used to represent like elements. The primary difference between the cable 30 and the embodiment of FIG. 1 is size. Specifically, the cable 30 of FIG. 2 has a larger diameter to accommodate a greater quantity of insulated wires 16 comprising the plurality 14 of insulated wires. In this regard, the outer sheath 12 of the cable 30 includes a quantity of at least ten insulated wires 16, each having a conductive core 18 surrounded by an electrically insulative material 20. As with the previously described embodiment, the cable 30 includes at least one pair 26 of insulated wires that are twisted around another (indicated by the dashed line). The cable 30 further includes a sheath ground wire 22, which is a bare wire having a conductive core 24 devoid of insulation. In an alternate embodiment, there may be a plurality of sheath ground wires 22. A binder or separation layer 28 binds the insulated wires 16 together in the outer sheath 12 and separates them from the sheath ground wire 22.

Figure 3:
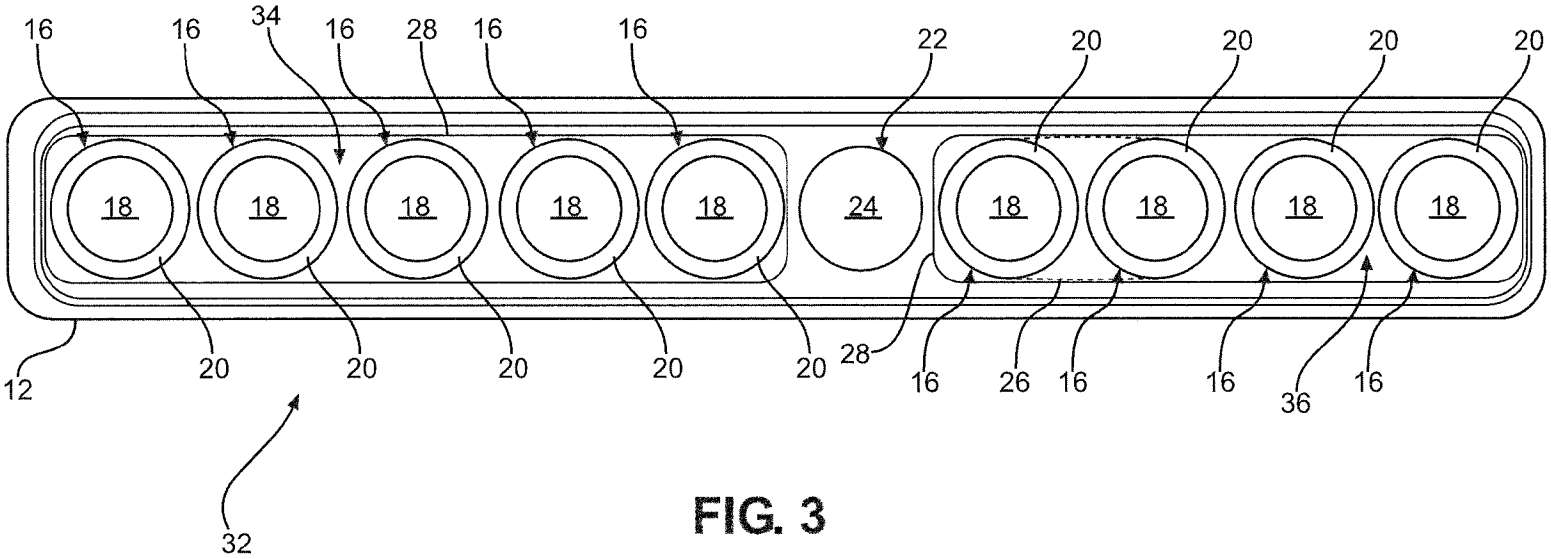
FIG. 3 schematically illustrates a cross-sectional diagram of another embodiment of a cable having a different cross-sectional shape from the cables of FIGS. 1 and 2.

FIG. 3 schematically illustrates a cross-sectional diagram of another embodiment of a cable 32 in which like reference numerals are used to represent like elements. There are several differences between the cable 32 and previously described embodiments. First, the shape of the cross-section corresponds to a rectangular shape. In particular, to a rectangular shape having rounded corners. In alternate embodiments, other shapes may be used.

Second, there are two sets or groups of insulated wires 16. That is, there is a plurality 34 of insulated wires 16 disposed towards one side of the rectangular shape and another plurality 36 of insulated wires 16 disposed on the opposite side of the rectangular shape. Moreover, the quantity of insulated wires 16 is different. The first plurality 34 of insulated wires 16 disposed on the left side of the rectangular shape includes a total of five insulated wires 16. The other plurality 36 includes a total of four insulated wires 16. In alternate embodiments, the quantities on each side may be reversed with one another, different quantities provided, the same quantity provided for each plurality 34 and 36, or a single plurality provided as in previous embodiments.

Each plurality 34 and 36 of insulated wires 16 in the cable 32 is surrounded by a separation layer 28 binding the insulated wires 16 of its respective plurality together. The separation layer 28 is like the separation layer described for previous embodiments. The pluralities 34 and 36 of insulated wires 16 extend through an outer sheath 12, which except for the shape, is like the other outer sheath in the previously described embodiments. Each insulated wire 16 includes an electrically conductive core 18 surrounded by an electrically non-conductive material 20, i.e., a coating of a flexible electrical insulator. Further, in at least one of the pluralities 34 and 36 of insulated wires 16, there are two insulated wires 16 that form a twisted pair 26, which is indicated by the dashed line. In alternate embodiments, each plurality 34 and 36 of insulated wires 16 may include one or more twisted pairs 26 or no insulated wires 16 that are twisted around one another.

The cable 32 includes a sheath ground wire 22 disposed between the two pluralities 34 and 36 of insulated wires. The sheath ground wire 22 includes an electrically conductive core 24 devoid of insulation. The sheath ground wire 22 is like the sheath ground wire in the previously described embodiments. In particular, the sheath ground wire 22 extends through the interior of the outer sheath 12 and makes direct electrical contact therewith for grounding the outer sheath. To maintain electrical contact, the sheath ground wire 22 is not bound by a separation layer 28 with any of the other insulated wires 16. In alternate embodiments, the sheath ground wire 22 may be positioned at other locations relative to the pluralities 34 and 36 of insulated wires 16, for example, adjacent the left or right sides of the rectangular shape. In yet other alternate embodiments, a plurality of sheath ground wires 22 may be provided for more even distribution of grounding for the outer sheath 12.

Figure 4:
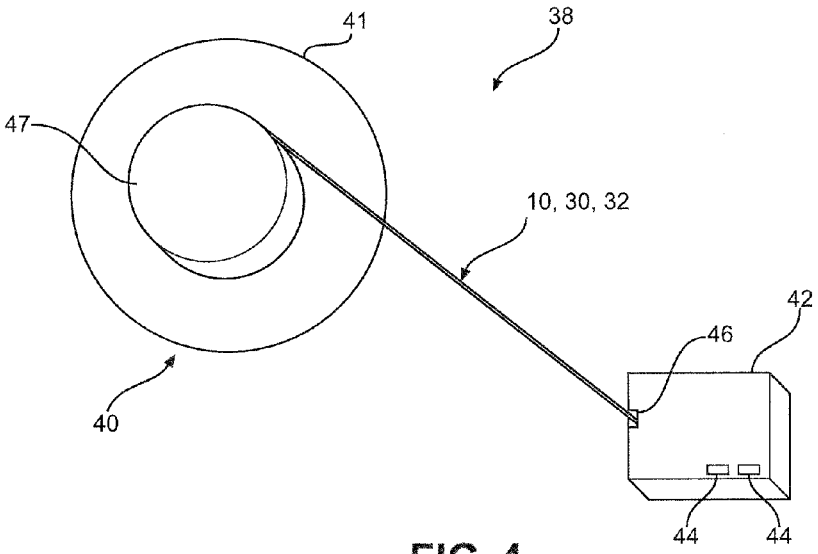
FIG. 4 schematically illustrates an embodiment of a cable assembly including a cable from FIG. 1, 2 or 3.

FIG. 4 schematically illustrates an embodiment of a cable assembly indicated generally by reference numeral 38. The cable assembly 38 includes a cable 10, 30 or 32 as previously described and a cable retraction mechanism 40. The cable retraction mechanism 40 includes at least a portion of the cable 10, 30 or 32 disposed thereon. In particular, the cable retraction mechanism 40 is operable to retract a greater portion of the cable 10, 30 or 32 thereto and also operable to extend more of the cable therefrom.

The cable retraction mechanism 40 includes a spool or reel 41 from which the cable 10, 30 or 32 is retracted and extended. In particular, the cable 10, 30 or 32 winds onto the reel 41. When the reel 41 rotates in one direction, a greater portion of the cable 10, 30 or 32 is wound onto the reel and the cable retracts towards the retraction mechanism 40. When the reel 41 rotates in the opposite direction, a greater portion of the cable 10, 30 or 32 is unwound from the reel and more of the cable extends therefrom. The cable retraction mechanism 40 may be of conventional design. For example, suitable cable retraction mechanisms are commercially available from Telefonix, Inc. of Waukegan, Ill., USA.

Incorporated herein by reference in its entirety is the disclosure of U.S. Pat. No. 8,435,069, issued May 7, 2013 to Burke et al., which discloses embodiments of a retraction mechanism suitable for use with the cable 10, 30 or 32. As disclosed in the patent, the cable retraction mechanism 40 may include a tension element disposed within and coupled to a reel for functioning to resist dispensing or extending more cable from the reel. Further, a base or housing may be provided enclosing and rotatably supporting the reel. A ratchet is attached to the housing for selectively restraining rotation of the reel whereby the cable may be maintained in an extended position or retracted and wound onto the reel. In particular, the cable extends through an opening in the housing. The housing is adapted via mounting holes for fastening to a surface in a vehicle, such as under a passenger seat or other location.

In this regard, the cable 10, 30 or 32 is intended for use with an entertainment system on a vehicle, such as for example, an in-flight entertainment system on an aircraft. An in-flight entertainment system is often abbreviated as IFE or sometimes as IFEC for in-flight entertainment and connectivity. The cable 10, 30 or 32 may be used for entertainment systems on other types of vehicles as well such as on trains for example and other vehicles.

The cable assembly 38 further includes a line-replaceable unit 42, often abbreviated as LRU, which abbreviation is hereafter used in the specification. The LRU 42 may for example be a video display, smart monitor, or handset or passenger control unit (PCU) for interacting with a smart monitor or other information processing device. The distal end of the cable 10, 30 or 32 connects to the LRU 42 and the other end is disposed on the cable retraction mechanism 40. The line-replaceable unit 42 is of conventional design and available from Panasonic Avionics Corporation of Lake Forest, California, USA. One end of the sheath ground wire 22 in the cable 10, 30 or 32 connects to ground in the cable retraction mechanism 40 or of structure to which the cable retraction mechanism mounts or fastens. The other end of the sheath ground wire 22 connects to ground in the LRU 42.

The LRU 42 includes one or more USB ports 44 (two are shown in FIG. 4). At least some of the insulated wires 16 in the cable 10, 30 or 32 connect to the USB port or ports 44. For example, at least one twisted pair 26 connects to a USB port 44 to support communication of electrical data signals over the cable 10, 30 or 32. Another insulated wire 16 connects to the USB port 44 for providing power, and one other insulated wire 16 connects to the port 44 for ground. If a cable 30 or 32 including additional insulated wires 16 beyond that required to support a standard USB port is used, the additional wires may be used to connect to another port in the LRU 42, which could be a USB port or other type, such as an Ethernet port for example. The other end of the cable 10, 30 or 32, i.e., the proximal end, connects to a port or electrical connector in the cable retraction mechanism 40 to complete a connection to the LRU 42. For example, the proximal end of the cable 10, 30 or 32 passes through or along the axis or hub 47 of the reel 41 and connects to a port or electrical connector. In alternate embodiments, the cable 10, 30 or 32 may terminate in electrical connectors that connect to a port or ports 46 in the LRU 42.

Figure 5:
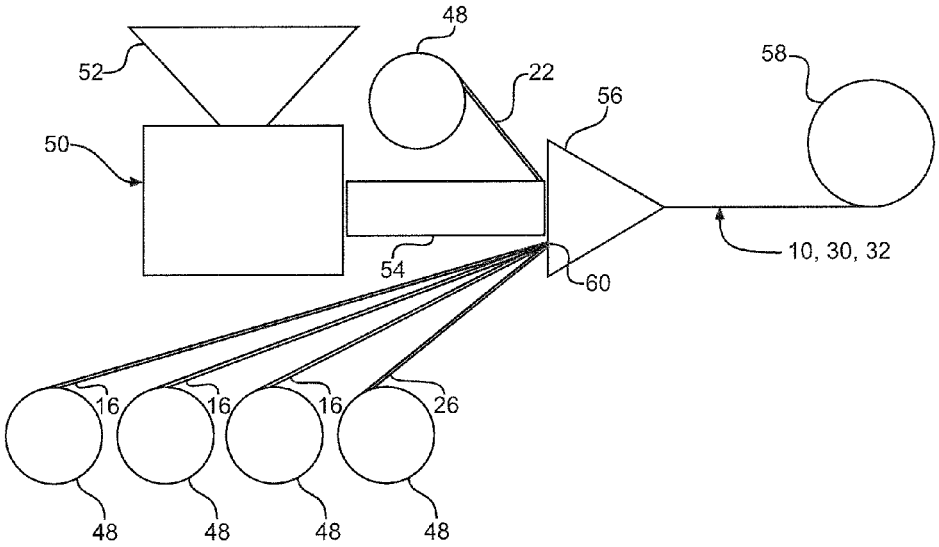
FIG. 5 schematically illustrates a method or process for making a cable of FIG. 1, 2 or 3 using an extruder machine.

FIG. 5 schematically illustrates a method or process for making a cable 10, 30 or 32. The method includes providing a plurality of electrically insulated wires 16. The wires 16 are as described previously, i.e., each wire 16 includes an electrically conductive core 18 surrounded by a substantially electrically non-conductive material 20, i.e., a coating of a flexible electrical insulator (see FIGS. 1 through 3). The method also includes providing a ground wire 22. The ground wire 22 is as previously described in connection with FIGS. 1 through 3, i.e., a wire 22 devoid of electrical insulation and including an exposed electrical core. Typically, the wires 16 and 18 are provided on spools or reels 48 as shown in FIG. 5 for convenient dispensing of wire therefrom. In alternate embodiments of the method, the wires 16 and 18 could be provided in coils retained in boxes for likewise convenience in dispensing therefrom.

The method includes extruding an outer sheath 12 around the electrically insulated wires 16 and the ground wire 22, with the outer sheath 12 comprising a polymeric material mixed with an electrically conductive material. As previously described, the electrically conductive material renders the outer sheath semiconductive as the term is used in the plastics industry, i.e., has an electrical conductivity between that of a metal and an electrically insulative material. In particular, the outer sheath 12 is as previously described in connection with FIGS. 1 through 3.

With reference to FIG. 5, the extruding is preferably performed using an extruder machine 50. The extruder machine 50 includes a hopper 52 into which the polymeric material in pellet or granular solid form is disposed. The conductive material may be premixed with the polymeric material, added separately to the hopper, or injected later.

The hopper 52 directs or funnels the polymeric material into the extruder machine 50. A feed screw 54 in the machine draws the content from the hopper 52 into the machine 50, which uses heat and compression to plasticize the polymeric material into a melt. The feed screw 54 forces the melt through a die 56. While the melt is forced through the die, the wires 16 and 22 are drawn therethrough to extrude the outer sheath 12 around the wires to form the cable 10, 30 or 32. The cable 10, 30 or 32 is cooled to solidify the other sheath 12 and wound onto a spool or reel 58 or alternatively into a box for later use.

The cross-sectional shape of the cable 10, 30 or 32 is controlled by the outlet of the die 56. If a cross-sectional shape corresponding substantially to a circle is desired, a die 56 is employed having a circular opening through which the melt is forced around the wires 16 and 22. If a cross-sectional shape corresponding substantially to a rectangle is desired, a die 56 is used having a rectangular opening.

The method further comprises wrapping at least some of the electrically insulated wires 16 together prior to extruding the melt through the die 56. Wrapping is schematically indicated by the dot 60 as the insulated wires 16 enter the extruder machine 50. As described previously in connection with FIGS. 1-3, the cable 10, 30 or 32 includes a separation layer 28, which is preferably applied in the form of a tape. The wrapping prior to extruding preferably comprises wrapping PFTE tape around a plurality 14 of electrically insulated wires 16. More preferably, the wrapping has an overlap of at least 25%.

If a cable 10, 30 or 32 having a substantially circular cross-section is desired, the wrapping is accordingly applied to bundle or arrange the electrically insulated wires 16 together in the plurality 14 to have a substantially circular cross-section. If a substantially rectangular cross-section is desired, the wrapping is applied to achieve a substantially rectangular shape or shapes as in FIG. 3. As described earlier, the sheath ground wire 22 is not wrapped to maintain it in direct electrical contact with the interior of the outer sheath 12.

The method further comprises wrapping or twisting at least two of the insulated wires 16 around one another along their length prior to the extruding. The wrapping or twisting forms a twisted pair 26 of electrically insulated wires 16 as described previously in connection with FIGS. 1-3. The wrapping or twisting may be performed in advance and provided on a spool or reel 48 as shown in FIG. 5. In an alternate embodiment of the method, the wrapping or twisting may be performed as the wires 16 are drawn into the extruder machine 50.

Figure 6:
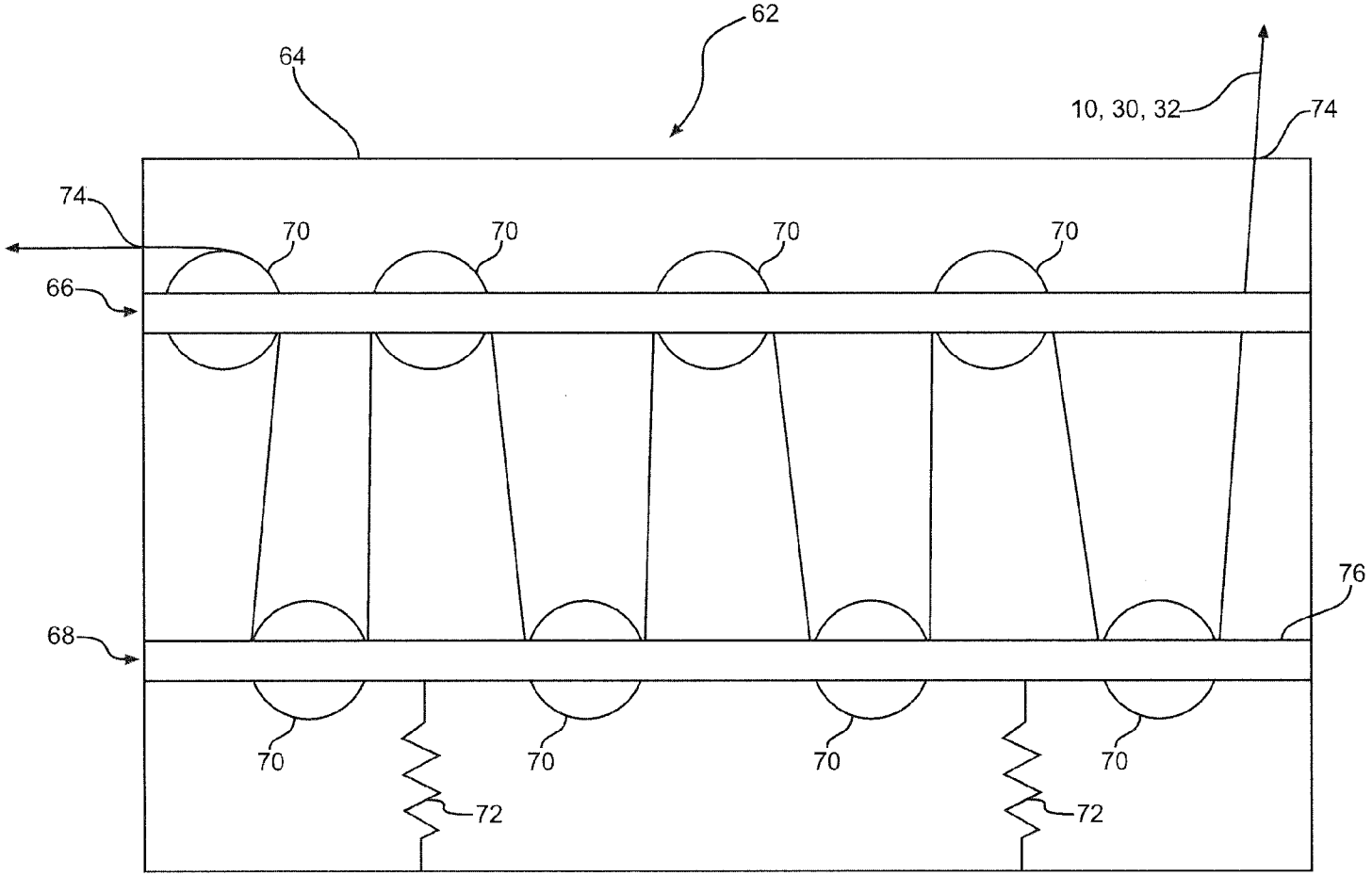
FIG. 6 schematically illustrates a portion of an alternate embodiment of a cable retraction mechanism for use with the cable assembly of FIG. 4.

FIG. 6 schematically illustrates a portion of an alternate embodiment of a cable retraction mechanism 62. The cable retraction mechanism 62 includes a frame or housing 64, into which a portion of a cable 10, 30 or 32 extends. Mounted within the housing are two rows 66 and 68 of rotatably mounted pulleys 70. One of the rows 68 is movably mounted within the housing and permitted to move toward and away from the other row 66. Moreover, the moveably mounted row 68 is biased by springs 72 to pull away from the other row 66.

The housing 64 includes first and second openings 74 for the cable 10, 30 or 32. One end of the cable 10, 30 or 32 passes out of one of the openings 74 and connects to an LRU 42 as previously described (see FIG. 4). The other end of the cable 10, 30 or 32 pass out of the other opening 74 of the housing 64 to an electrical port or terminates in an electrical connector for connection to an electrical port. When either end of the cable 10, 30 or 32 is pulled, the springs 72 extend, permitting a greater portion of the cable to extend out of the cable retraction mechanism 62. If the force pulling on the cable 10, 30 or 32 is removed, the springs 72 contract and retract a greater portion of the cable into the cable retraction mechanism 64.

The moveable row 68 of pulleys 70 mount to a moveable member 76 so that the pulleys 70 mounted thereto all move together. The moveable member 76 preferably includes opposite ends that move along tracks on the interior of the housing 64. In addition, the ends of the moveable member 76 and the tracks preferably include interfacing ribs and slots that provide a ratcheting function, to selectively lock the moveable member 76 in place. The cable retraction mechanism 64 of FIG. 6 may be used in the cable assembly 38 of FIG. 4, instead of the previously described cable retraction mechanism 40.

Figure 7:
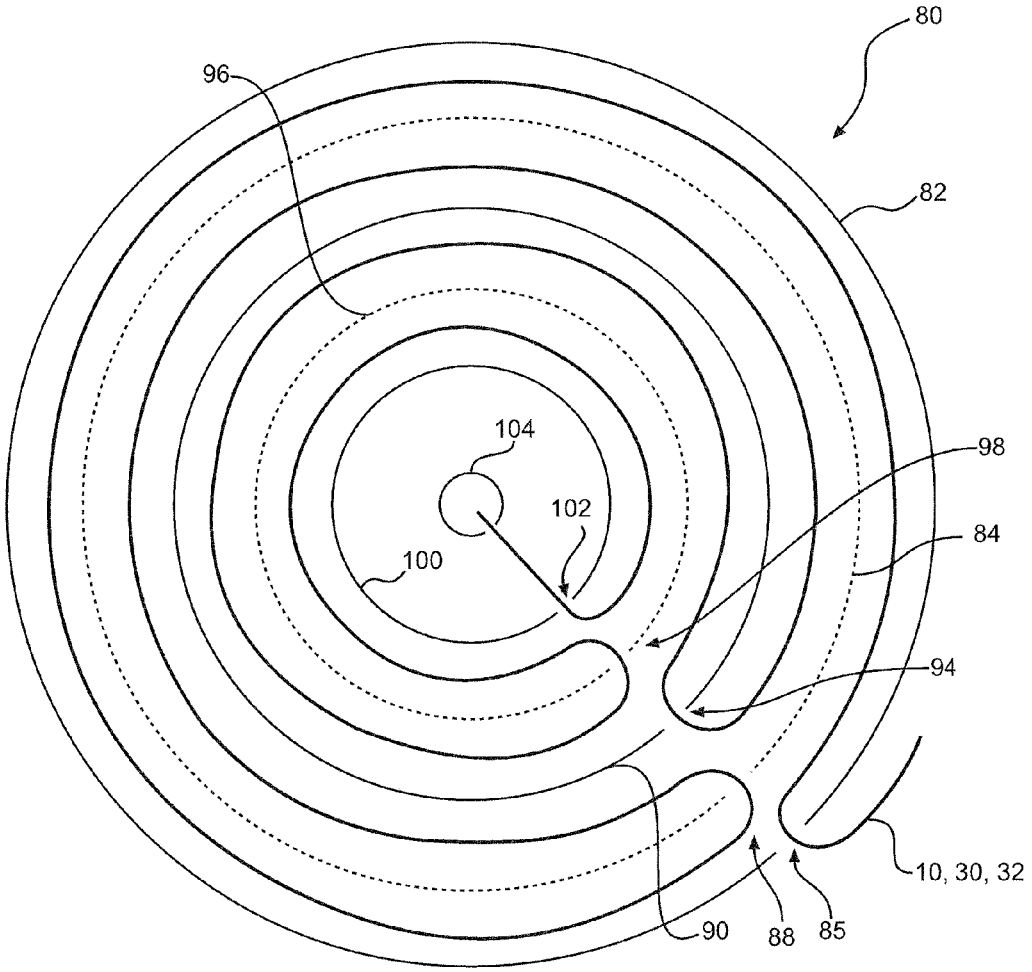
FIG. 7 schematically illustrates a portion of another alternate embodiment of a cable retraction mechanism for use with the cable assembly of FIG. 4.

FIG. 7 schematically illustrates a portion of another alternate embodiment of a cable retraction mechanism 80, which may alternatively be used in the cable assembly 38 of FIG. 4 instead of the previously described cable retraction mechanisms 40 and 64.

In this regard, FIG. 7 shows a schematic cross section of the cable retraction mechanism 80. The cable retraction mechanism 80 includes a cylindrical frame or housing 82, into which a portion of a cable 10, 30 or 32 extends. Mounted concentrically within the housing 82 is a first or outer rotatable guide 84 (shown by a dashed line to indicate that it is rotatable). The cable 10, 30 or 32 extends through an opening 85 in the housing 82 and passes counter-clockwise between the outer rotatable guide 84 and the housing 82.

With continued reference to FIG. 7, when the cable 10, 30 or 32 has nearly completed a 360 degree circuit around the outer rotatable guide 84, the cable 10, 30 or 32 passes deeper into the interior of the mechanism 80 through an opening 88 in the outer rotatable guide 84. After passing through the opening 88 in the outer rotatable guide 84, the cable reverses direction to pass clockwise between the outer rotatable guide 84 and a first inner fixed guide 90.

Once the cable 10, 30 or 32 has passed nearly around the first fixed inner guide 92, the cable passes further into the mechanism 80 through an opening 94 in the first fixed inner guide 92. After passing the opening 94 in the first fixed inner guide 92, the cable 10, 30 or 32 reverses direction again and passes counter-clockwise between the first fixed inner guide 92 and an inner rotatable guide 96 (shown by a dashed line).

After the cable 10, 30 or 32 has passed almost completely around the inner rotatable guide 96, the cable passes deeper into the center of the mechanism 80 through an opening 98 in the inner rotatable guide 96. Thereafter the cable 10, 30 or 32 reverses course and extends clockwise between the inner rotatable guide 96 and an inner fixed guide 100. After almost completely wrapping around the inner fixed guide 100, the cable 10, 30 or 32 passes through an opening 102 in the fixed inner guide to an opening 104 at the axis of the mechanism 80. The cable 10, 30 or 32 extends through the opening 104 at the axis and connects to a port or cable connector, such as USB connector. The port or cable connector may be disposed with the mechanism 80 or externally thereto.

Figure 8:
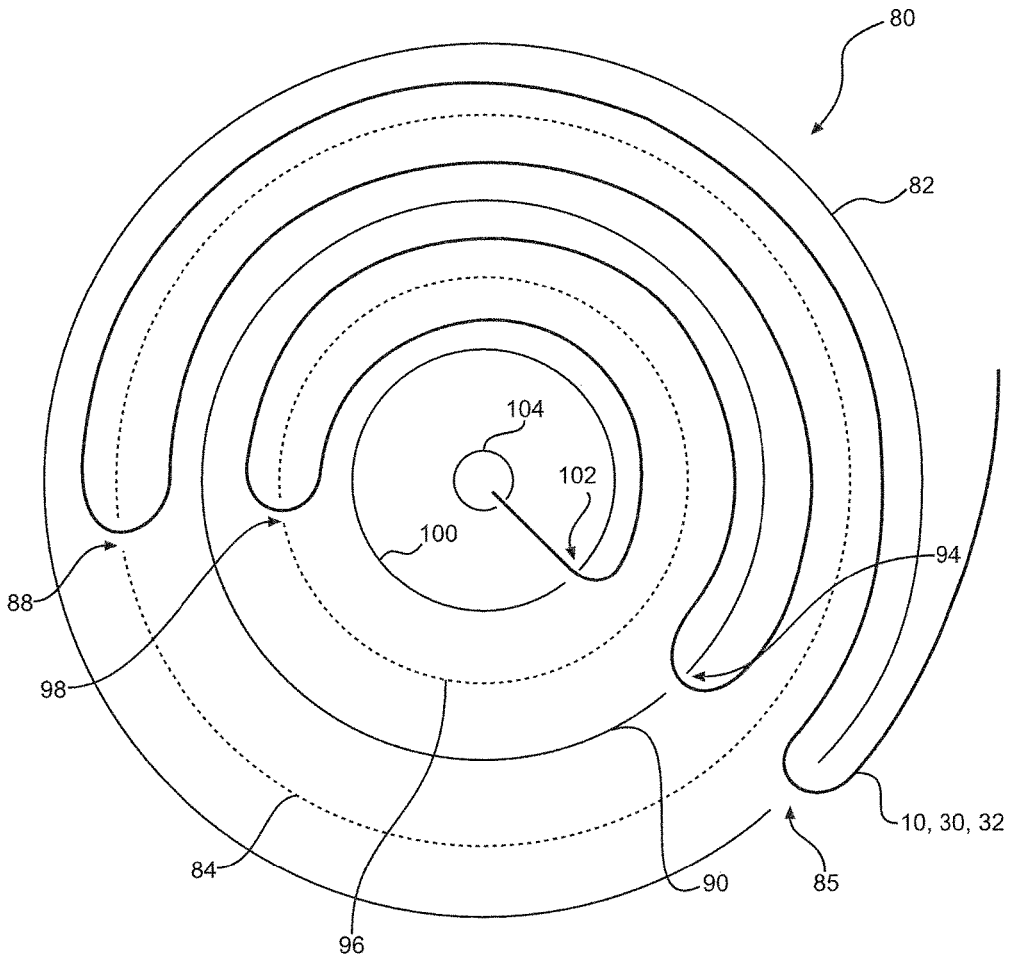
FIG. 8 schematically illustrates the cable retraction mechanism of FIG. 7 with a greater portion of the cable extended from the mechanism.

FIG. 8 schematically illustrates the cable retraction mechanism 80, with the cable 10, 30 or 32 more fully extended from the mechanism 80. As the cable 10, 30 or 32 is more fully extended from the mechanism 80, the rotatable guides 84 and 96 rotate. In particular, the rotatable guides 84 and 96 each rotate clockwise. This decreases the distance clockwise between the opening 88 of the outer rotatable guide 84 and the opening 94 of the outer fixed guide 90. The same is true for the distance clockwise between the opening 98 in the inner rotatable guide 96 and the opening 102 in the inner fixed guide 100. Finally, the distance clockwise between the opening 84 in the outer rotatable guide 84 and the opening 85 in the housing 82 also decreases. Due to the decreased distances, less of the cable 10, 30, or 32 is taken-up inside of the mechanism 80, and a greater portion of the cable is extended from the mechanism 80.

Figure 9:
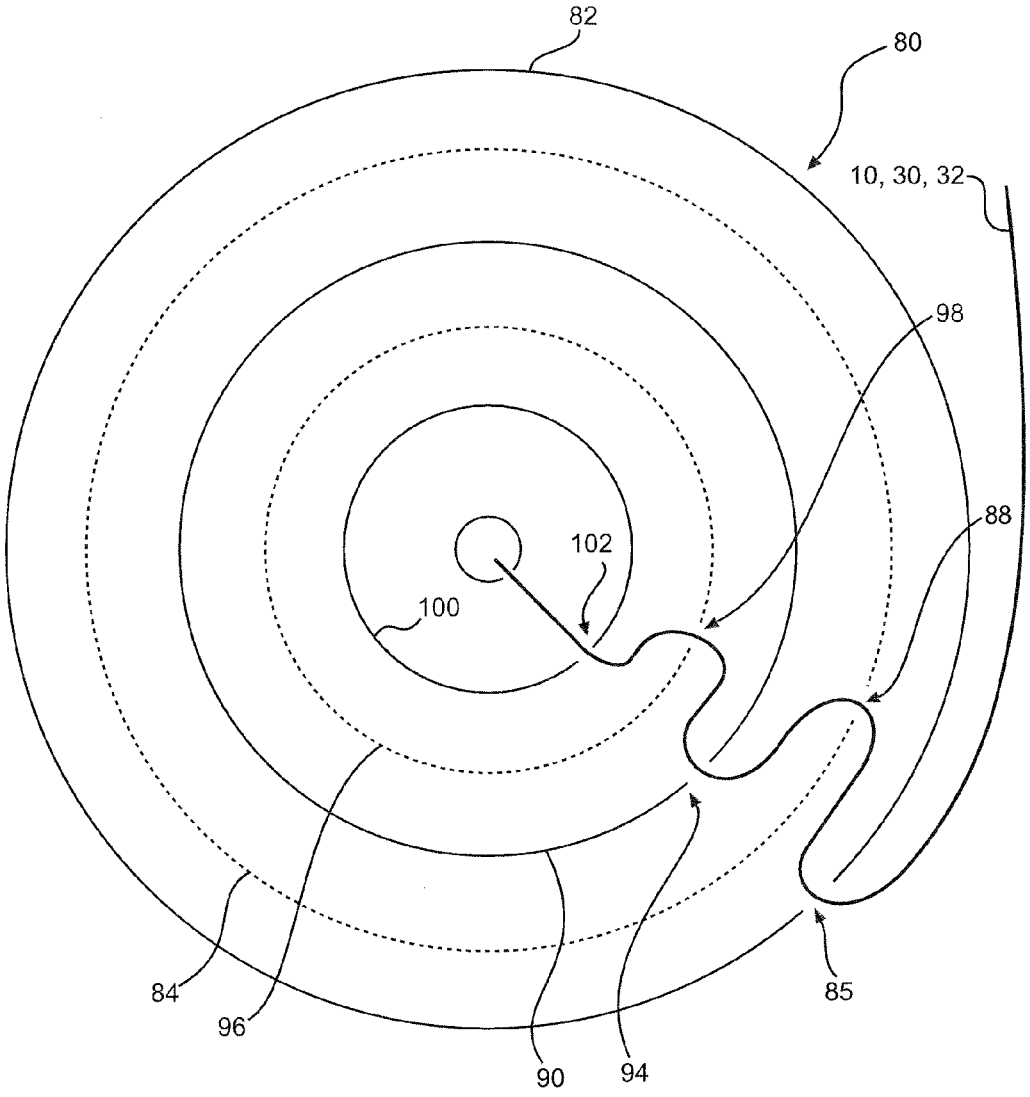
FIG. 9 schematically illustrates the cable retraction mechanism of FIG. 7, with the cable near its maximum amount of extension from the mechanism.

FIG. 9 schematically illustrates the cable retraction mechanism 80 of FIG. 7, with close to the maximum amount of cable 10, 30 or 32 extended from the mechanism 80. In this state, the openings 88 and 98 in the rotatable guides 84 and 96 nearly radially align with the openings 94 and 102 in the fixed guides 90 and 100 and also with the opening 85 in the housing 82. Since the openings 85, 88, 94, 98 and 102 all nearly radially align, the distances between openings is substantially reduced and a greater portion of the cable 10, 30 or 32 is extended from the mechanism 80, i.e., a lesser amount of the cable length is taken-up inside the mechanism. The cable 10, 30 or 32 is at its maximum extended length from the mechanism 80 when all of the openings 85, 88, 94, 98 and 102 are in complete radial alignment on one side of the mechanism 80 and the least amount of cable is taken-up.

Preferably, the mechanism 80 shown in FIGS. 7-9 is biased to maintain the cable 10, 30 or 32 retracted therein. For example, the rotatable guides 84 and 96 may be biased with a spring to maintain return to their most counter-clockwise position. In addition, the mechanism 80 preferably includes a ratchet such that the cable 10, 30 or 32 may be selectively extended and maintained thereat, until the ratchet is tripped, whereupon the cable retracts.

While embodiments may be illustrated or described as having certain components, additional, fewer, or different components may be used or substituted. For example in the cable retraction mechanism 80 of FIGS. 7-9, a slidable lock could be employed instead of a ratchet for selectively maintaining the cable 10, 30 or 32 at an extended position against biasing springs, such as torsion springs. Moreover, additional rotatable guides and fixed guides could be provided for taking up a greater length of cable 10, 30 or 32 within the cable retraction mechanism 80.

In the cable retraction mechanism 62 of FIG. 6, a single centrally disposed spring 72 could be used instead of two spaced springs. Instead of using tension springs 72, a compression spring could be used between the two rows 66 and 68 of pulleys 70 to push the rows away from one another. Further, with respect to described methods or processes, various steps may be performed in different order, and fewer or more steps may be performed by combining or splitting steps, or omitting some steps. In FIG. 5 for example, a conductive material may be pre-combined with the polymeric material disposed in the hopper 52 or the conductive material may be injected separately and mixed with the polymeric material after it has been converted to a melt.

In the twisted pair 26 of insulated wires 16, a filler wrap could be provide to fill gaps in the twisted pair and maintain the wires twisted around another. Preferably, the wires 16 are twisted around one another in a range from two to eight twists per inch, and more preferably around four twists per inch. Adhesives or bonding agents could be applied as well to the twisted pair 26 and other wires 16 and 22 to maintain their positions and for filling gaps.

Since changes can be made as described, the present examples and embodiments are to be considered as illustrative and not restrictive and the invention is not to be limited to the details given herein, but may be modified within the scope and equivalence of the appended claims.

The invention claimed is:

1. A cable for communicating electrical signals, the cable comprising:

an outer sheath comprised of a polymeric material including an electrically conductive substance mixed with the polymeric material and causing the outer sheath to be electrically semiconductive, the outer sheath including a length and an interior;

a plurality of insulated wires extending through the interior of the outer sheath along the length thereof, each insulated wire including an electrically conductive core surrounded by an electrically non-conductive material; and a sheath ground wire disposed within the interior of the outer sheath and extending along the length thereof, the sheath ground wire including an electrically conductive core in direct electrical contact with the interior of the outer sheath at a plurality of locations; and wherein the sheath ground wire is in direct electrical contact with the outer sheath only at polymeric, semiconductive portions of the outer sheath.

2. The cable of claim 1, further comprising a plurality of electrically conductive strands forming at least one of the wires.

3. The cable of claim 1, wherein the plurality of insulated wires includes at least one pair of the plurality twisted around one another along the length of the outer sheath.

4. The cable of claim 1, wherein the electrically conductive substance comprises carbon.

5. The cable of claim 1, wherein the outer sheath includes a cross-section substantially corresponding to one of a rectangular shape and a circular shape.

6. The cable of claim 1, wherein the sheath ground wire is a bare wire devoid of individual electrical insulation.

7. The cable of claim 1, further comprising a separation layer surrounding the plurality of insulated wires and separating the insulated wires from contact with the sheath ground wire in the interior of outer sheath.

8. A cable assembly for communicating electrical signals, the cable assembly comprising:

a cable including:

an outer sheath comprised of a polymeric material including an electrically conductive substance mixed with the polymeric material and causing the outer sheath to be electrically semiconductive, the outer sheath including a length and an interior;

a plurality of insulated wires extending through the interior of the outer sheath along the length thereof, each insulated wire including an electrically conductive core surrounded by an electrically insulative material;

a sheath ground wire disposed within the interior of the outer sheath and extending along the length thereof, the sheath ground wire including an electrically conductive core in direct electrical contact with the interior of the outer sheath at a plurality of locations, wherein the sheath ground wire is in direct electrical contact with the outer sheath only at polymeric, semiconductive portions of the outer sheath; and a cable retraction mechanism on which at least a portion of the cable is disposed, the cable retraction mechanism being operable to retract a greater portion of the cable thereto and also operable to extend more of the cable therefrom.

9. The cable assembly of claim 8, wherein the cable is for use with an entertainment system on a vehicle and the cable includes a distal end extending from the cable retraction mechanism, the cable assembly further including a line-replaceable unit connected to the distal end of the cable.

10. The cable assembly of claim 9, wherein the outer sheath includes a cross-section substantially corresponding to one of a rectangular shape and a circular shape.

11. The cable assembly of claim 9, wherein the line-replaceable unit includes a USB port to which at least some of the wires in the plurality of insulated wires in the cable electrically connect to the USB port.

12. The cable assembly of claim 8, wherein the cable includes a separation layer surrounding the plurality of insulated wires and separating the insulated wires from contact with the interior of the outer sheath.

13. The cable assembly of claim 11, wherein the separation layer separates the insulated wires from contact with the interior of the outer sheath.

14. The cable assembly of claim 13, wherein the separation layer comprises polytetrafluoroethylene.

15. The cable assembly of claim 8, wherein the sheath ground wire is a bare wire devoid of electrical insulation within the outer sheath.

16. A method of making a cable for communicating electrical signals, the method comprising:

providing a plurality of electrically insulated wires, with each wire including an electrically conductive core surrounded by substantially electrically non-conductive material;

providing a ground wire, the ground wire being devoid of electrical insulation and including an exposed electrically conductive core;

extruding an outer sheath around the electrically insulated wires and the ground wire, the outer sheath comprising a polymeric material mixed with an electrically conductive material, which renders the outer sheath semiconductive.

17. The method of claim 16, further comprising wrapping at least some of the electrically insulated wires together prior to said extruding.

18. The method of claim 17, wherein the wrapping comprises polytetrafluoroethylene.

19. The method of claim 16, further comprising wrapping at least two of the insulated wires around one another along their length prior to said extruding.

20. The method of claim 16, wherein said extruding produces an outer sheath having a substantially rectangular cross-sectional area.

* * * * *